US005367799A

United States Patent [19]

Wilson et al.

[11] Patent Number: 5,367,799

[45] Date of Patent: Nov. 29, 1994

[54] IRON WITH FLUID DISTRIBUTING FINS AND THERMOSTAT ARRANGEMENT

[75] Inventors: Ian G. Wilson, Cheltenham; Richard L. Hoare, Neutral Bay; Leo Krusina, Campsie, all of Australia

[73] Assignee: Sunbeam Corporation Limited, Campsie, Australia

[21] Appl. No.: 996,031

[22] Filed: Dec. 23, 1992

[30] Foreign Application Priority Data

Dec. 24, 1991 [AU] Australia ..... PL0183

[51] Int. Cl.[5] ..... D06F 75/20; D06F 75/24

[52] U.S. Cl. ..... 38/77.7; 38/77.83; 219/254

[58] Field of Search ..... 38/77.5, 77.8, 77.82, 38/77.83, 88, 89, 93; 219/245, 250, 254

[56] References Cited

U.S. PATENT DOCUMENTS

| | | | |
|---|---|---|---|
| 2,677,126 | 5/1953 | Fitzsimmons | 38/77.83 |
| 2,700,236 | 1/1955 | Marvin et al. | 38/77.83 |
| 2,815,592 | 12/1957 | Gomersall | 38/77 |
| 2,846,794 | 8/1958 | Paulic | 38/77 |
| 2,906,043 | 9/1959 | Jepson et al. | 38/77.83 X |
| 3,599,357 | 8/1971 | Gronwick | 38/77.83 X |
| 3,711,972 | 1/1973 | Risacher | 38/77.83 |
| 3,820,259 | 6/1974 | Flowers | 38/77.83 X |
| 3,919,793 | 11/1975 | Toft et al. | 38/77.83 |
| 4,077,143 | 3/1978 | Walker et al. | 38/77.83 |
| 4,091,551 | 5/1978 | Schaeffer | 38/77.83 |
| 4,180,928 | 1/1980 | Davidson | 38/77.83 |
| 4,277,900 | 7/1981 | Gowdy | 38/77.83 |
| 5,025,578 | 6/1991 | Firatli | 38/93 |
| 5,105,525 | 4/1992 | Firatli | 29/527.3 |

FOREIGN PATENT DOCUMENTS

| | | | |
|---|---|---|---|
| 0358906 | 3/1990 | European Pat. Off. . | |
| 2490255 | 3/1982 | France . | |
| 3819132 | 12/1989 | Germany . | |
| 671069 | 11/1952 | United Kingdom . | |
| 2067600 | 7/1981 | United Kingdom | 38/77.83 |

OTHER PUBLICATIONS

Photocopy of T-Fal Sole Plate.

*Primary Examiner*—Clifford D. Crowder
*Assistant Examiner*—Ismael Izaguirre
*Attorney, Agent, or Firm*—Ladas & Parry

[57] ABSTRACT

A steam garment iron (10) having a sole plate (11) upon which there is mounted a body (15). Within the body (15) is a tank (14) which receives water to be delivered the sole plate (11) for the purposes of generating steam. The sole plate (11) has a number of fins (107) which radiate from a predetermined position (steam chest) (110) to where the water is delivered. The sole plate (11) also has a channel (111) extending longitudinally adjacent the heating element (44) into which water is pumped for the production of a jet of steam. Also mounted on the sole plate (11) is a thermostat (30), while the element (44) has a deviation portion (160) located adjacent the mounting (38) of the thermostat (30).

20 Claims, 8 Drawing Sheets

IRON WITH FLUID DISTRIBUTING FINS AND THERMOSTAT ARRANGEMENT

TECHNICAL FIELD

The present invention relates to irons and more particularly but not exclusively to domestic irons.

BACKGROUND OF THE INVENTION

Irons consist of a sole plate which supports above it the iron body. The body includes a tank to receive water together with a valve to regulate the delivery of water from the tank to the sole plate for the purposes of generating steam. Steam is gathered in a cavity formed above the sole plate and is delivered to the fabric being ironed by passages extending through the sole plate. Frequently irons are provided with a second means of delivering water to the sole plate. This second means is generally a pump which delivers a predetermined quantity of water to the sole plate upon being manipulated by a user of the iron. A burst of steam is then delivered from the sole plate.

The temperature of the iron is governed by a thermostat which may be mounted centrally or towards the front of the iron. The user via a dial mechanism or switch operates the thermostat to regulate the temperature of the sole plate.

Previously known irons have suffered several disadvantages including the following.

Water delivered to the sole plate for the purposes of generating a constant stream of steam, tends to migrate to the cooler portions of the sole plate. This exacerbates any temperature differences which may exist across the sole plate. This problem can be still further exacerbated if the thermostat is located adjacent one of these cooler regions. The thermostat may be deceived to permit excessive current to be delivered to the heating element. In extreme circumstances it has been known for one side of the sole plate to be 100° lower than the other side.

If the water delivered to the sole plate congregates at a cooler region, the operator can be deceived in thinking sufficient steam is being generated when the iron is placed in its rest position supported on its "heel". When the iron is oriented in this generally upright position the water migrates to hotter regions of the sole plate and generates more steam.

In irons where the temperature control knob is located generally centrally of the iron, it is necessary to have the thermostat spaced from the element due to the size of the thermostat. Thermostats are manufactured in set sizes which limits the distance they can be mounted from the temperature control knob. This leads to inaccuracies as the thermostat is not located adjacent the heating element. Accordingly in some instances the iron can be caused to overheat.

A still further disadvantage is the use of pumped water for the production of bursts of steam. The pumped water is delivered to a position directly on top of the heating element in order to manufacture sufficient steam. However the additional steam is not restrained and tends to distribute throughout the steam cavity (steam chest) thereby diminishing the quantity of steam delivered in the burst.

OBJECT OF THE INVENTION

It is the object of the present invention to overcome or substantially ameliorate the above disadvantages.

SUMMARIES OF THE INVENTION

There is disclosed herein an iron comprising:

a sole plate having an interior and exterior surface, the plate also having apertures through which steam is delivered to the exterior surface of the sole plate;

an iron body mounted on said sole plate and covering said interior surface;

a heating element in conductive heat contact with said sole plate to heat the sole plate upon delivery of electric current to said element;

a water tank in said body;

means to deliver water from said tank to said sole plate to generate steam for delivery to said apertures, said water delivery means having an outlet to direct the water to a predetermined location on said interior surface; and at least one fin generally radiating from said location to aid in distributing the water over said sole plate by cooling portions of the sole plate spaced from said location.

There is also disclosed herein an iron comprising:

a sole plate having an exterior and interior surface, said plate further having apertures through which steam is delivered to the exterior surface of the sole plate;

an iron body mounted on said sole plate and covering said interior surface;

a heating element in conductive heat contact with said sole plate to heat the sole plate upon the delivery of electric current to said element;

a water tank in said body;

means to deliver water from said tank to said interior surface to generate steam for delivery to said apertures, said water delivery means having an outlet to direct water to a predetermined location on said interior surface; and wherein said element is elongated and said sole plate at least partly encloses an elongated chamber extending along said element, said chamber being substantially closed and containing said location so that upon delivery of water to said location steam is generated in said chamber from where it is delivered via an outlet to said apertures.

There is still further disclosed herein an iron comprising:

a sole plate;

an iron body mounted on the sole plate;

a heating element in contact with said sole plate to heat the sole plate upon delivery of electric current to said element;

thermostat means mounted to detect a temperature of the sole plate to regulate the delivery of current to said element; and wherein said element is elongated so as to follow a generally U-shaped or V-shaped path, which path is located in a plane generally parallel to the sole plate and located towards the periphery of the sole plate, said path including a deviation extending towards said thermostat means so that said thermostat means is located adjacent a portion of said element corresponding with the deviation of said path.

BRIEF DESCRIPTION OF THE DRAWINGS

A preferred embodiment of the present invention will now be described by way of example with reference to the accompanying drawings wherein FIG. 1 A–B–C–D is a schematic parts exploded perspective view of an iron.

DETAILED DESCRIPTION OF THE PREFERRED EMBODIMENT

Figure 1A:
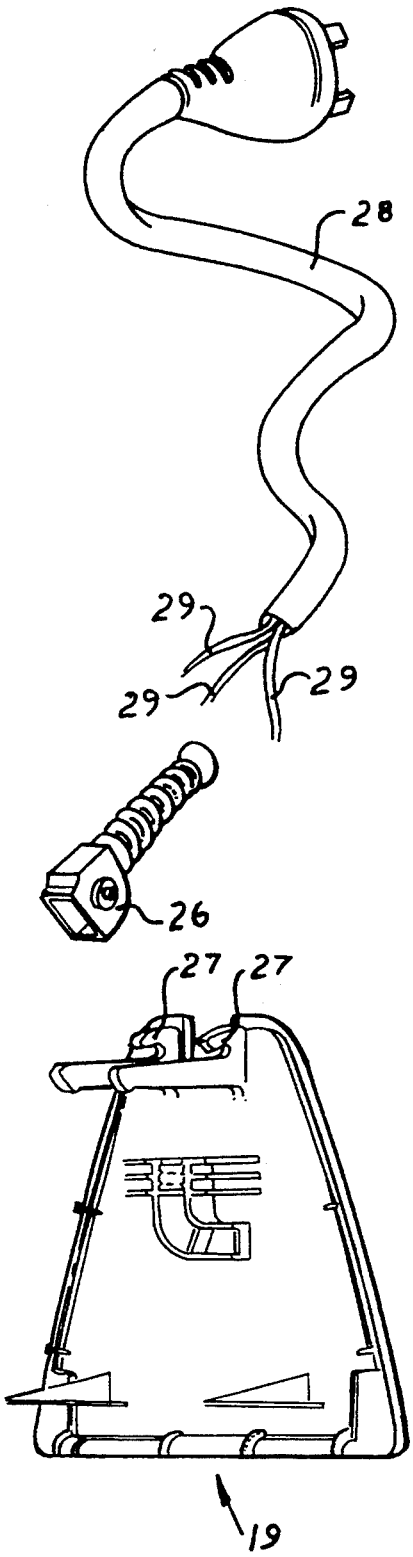
Figure 1B:
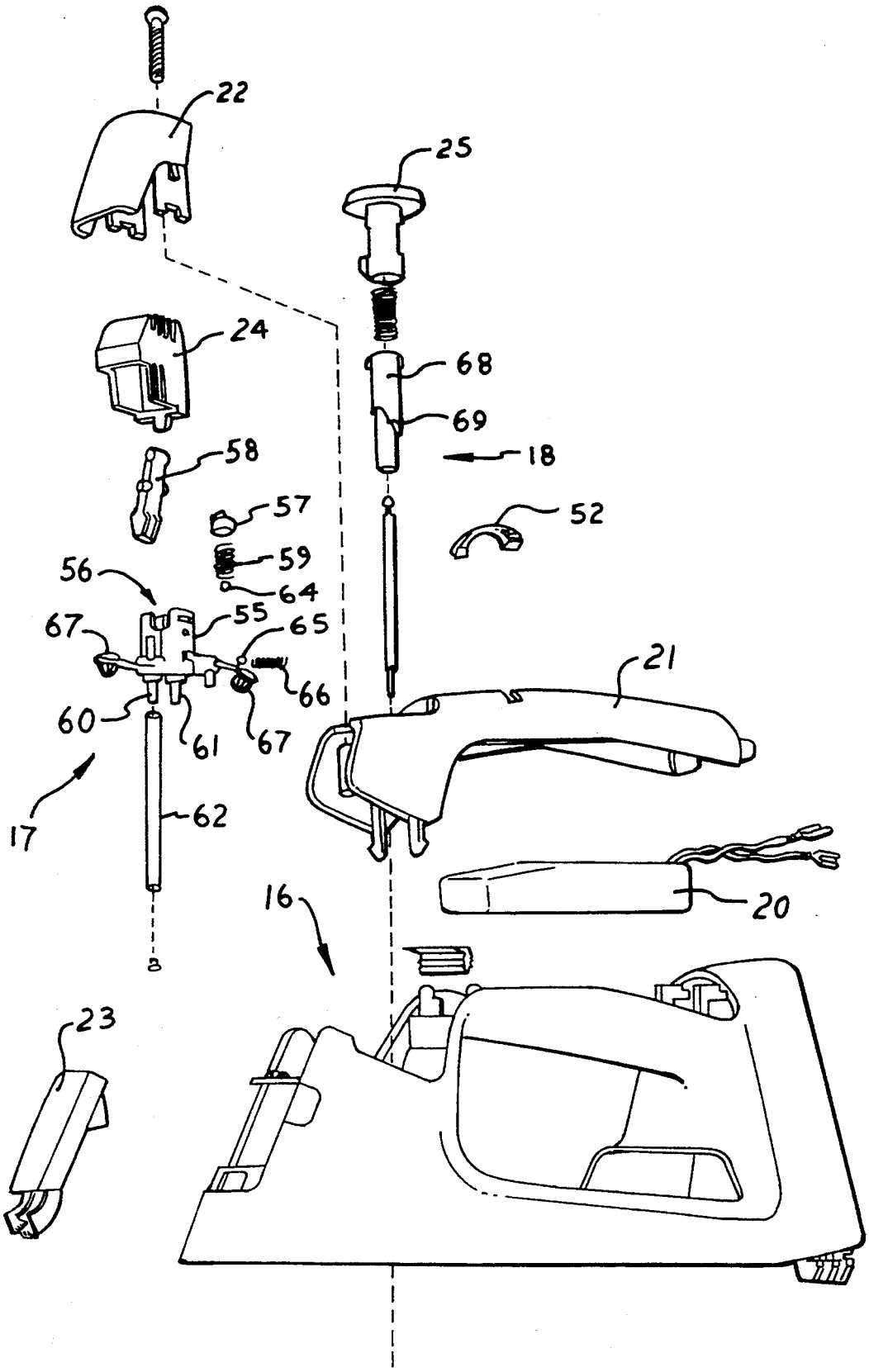
Figure 1C:
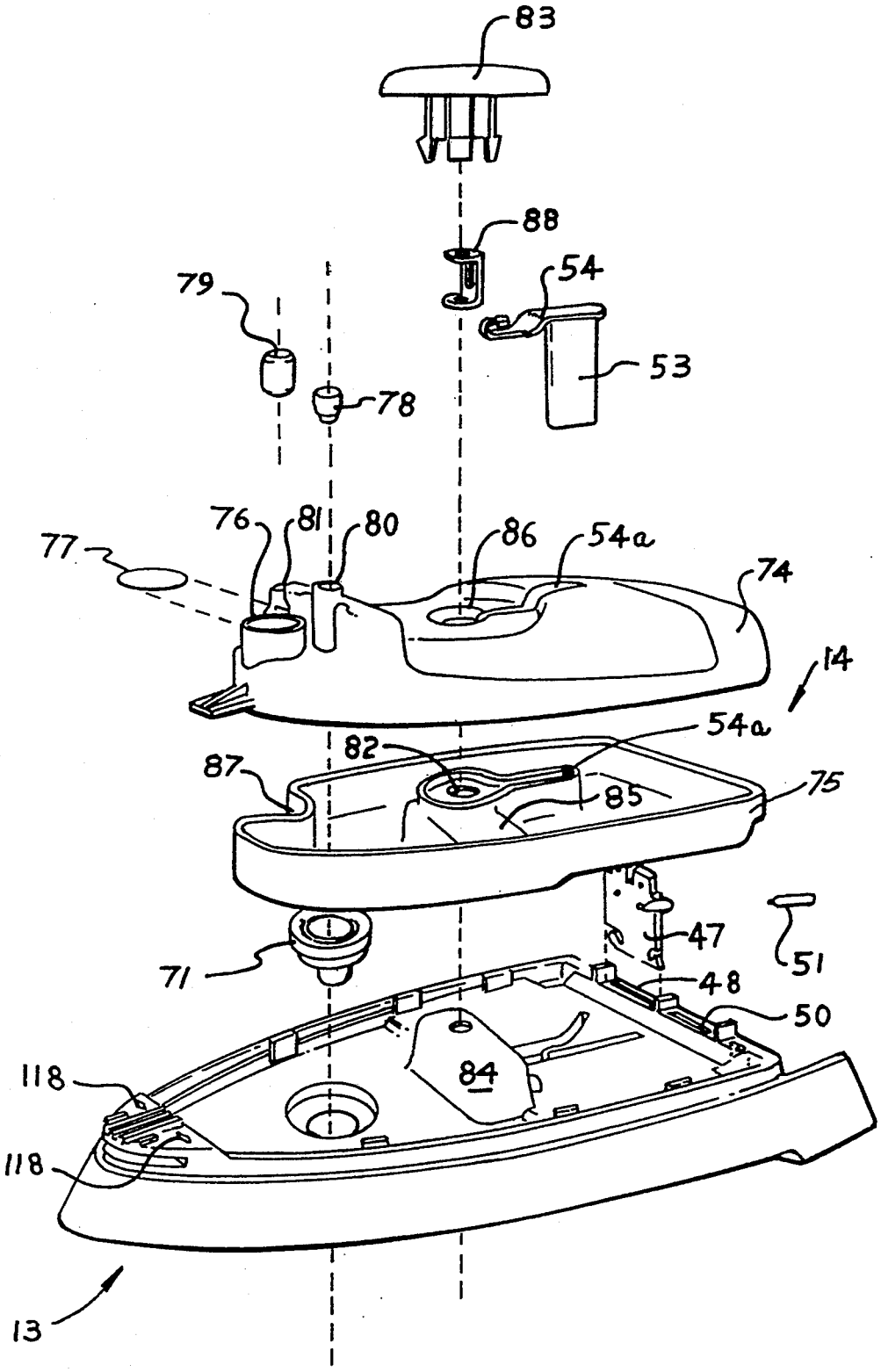
Figure 1D:
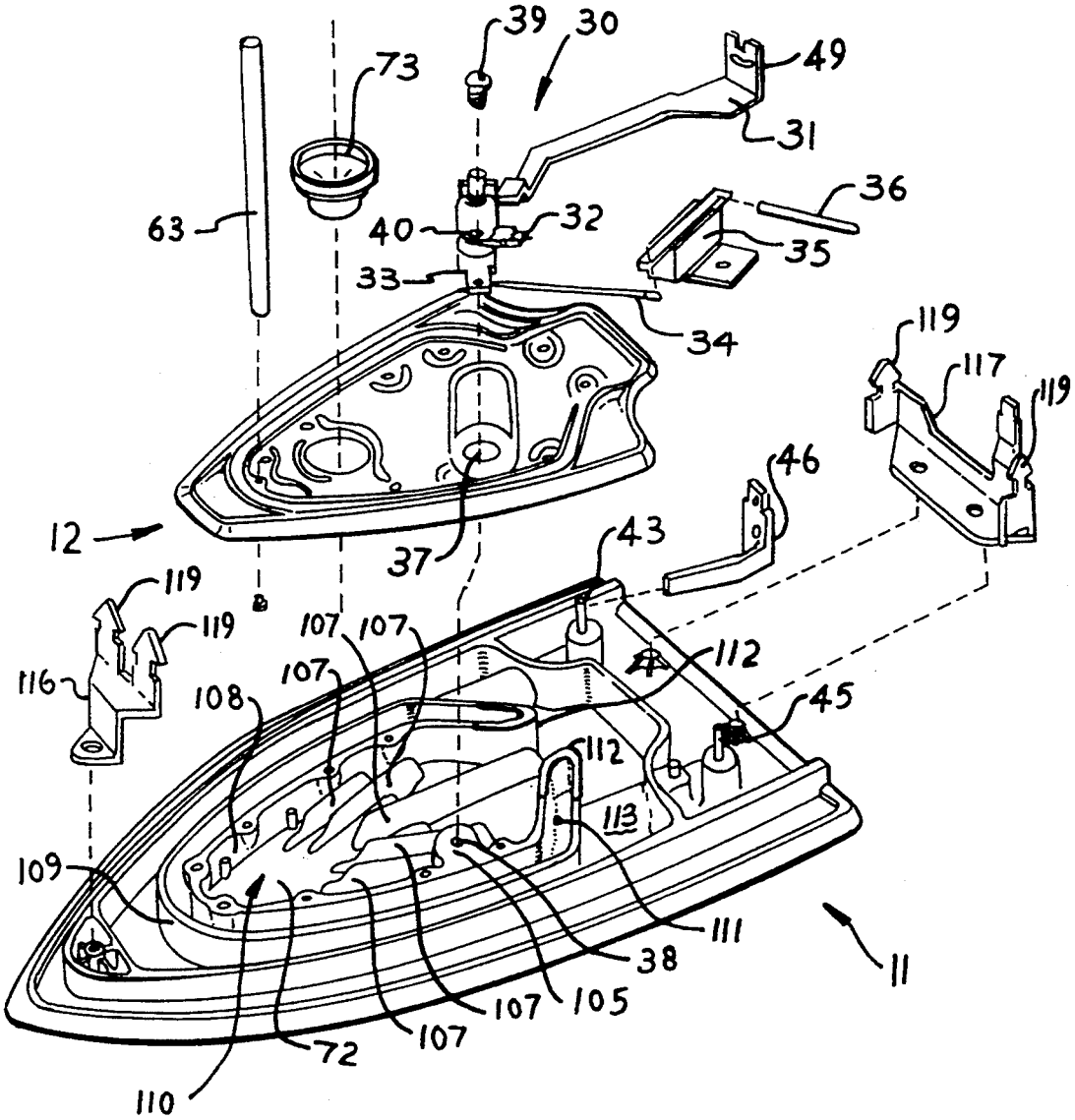
Figure 2:
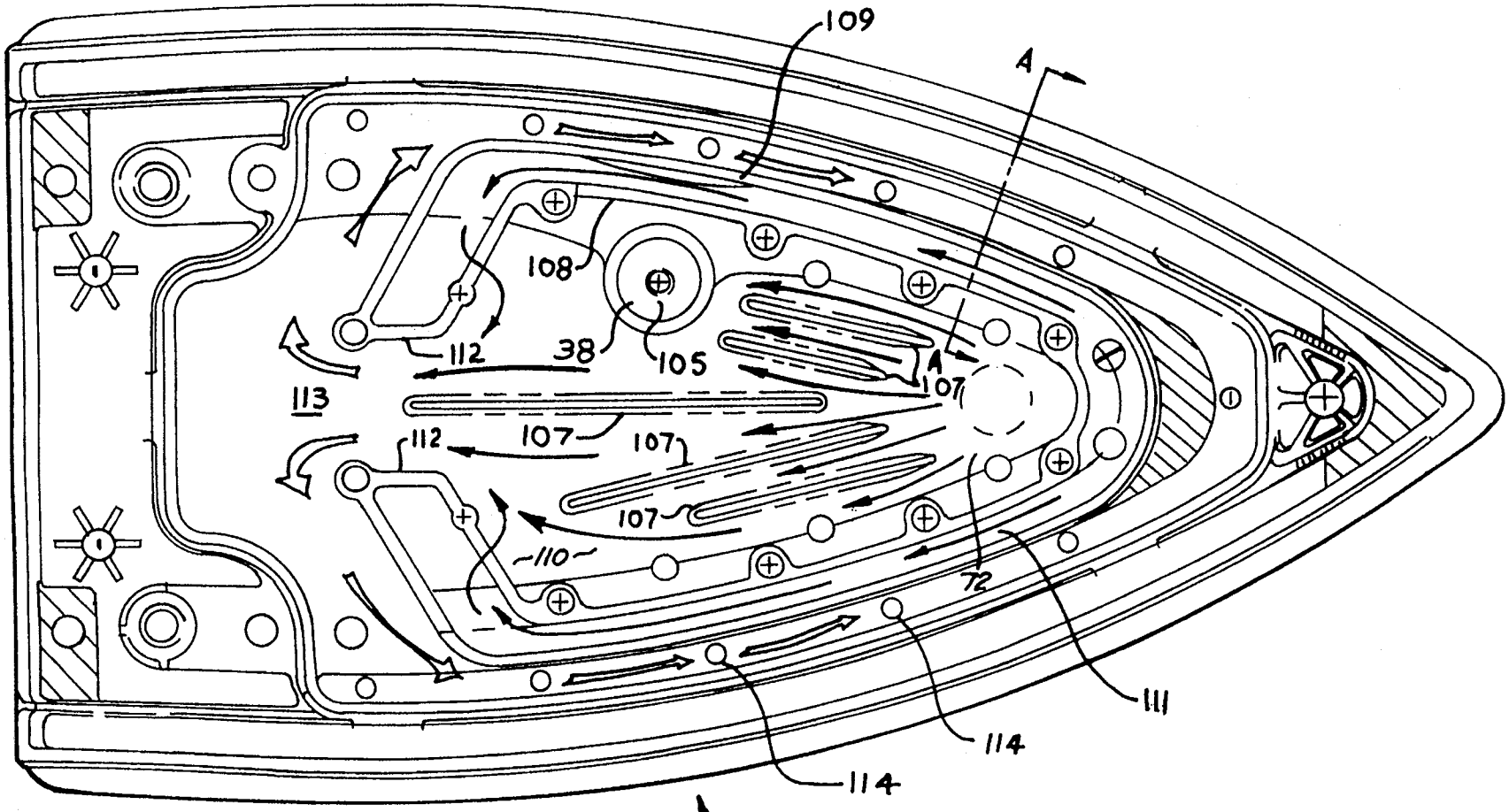
FIG. 2 is a schematic top plan view of the sole plate employed in the iron of FIG. 1.
Figure 4:
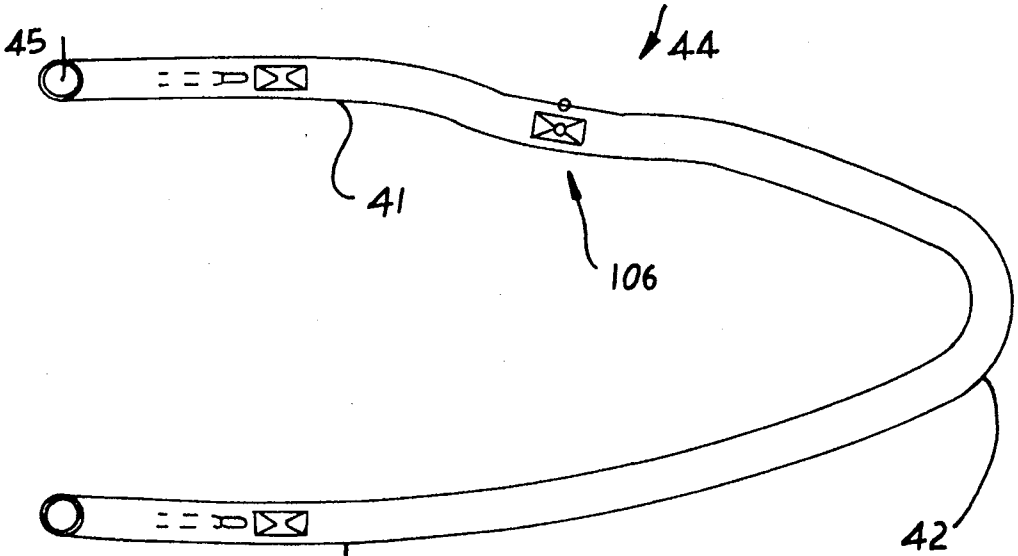
FIG. 4 is a schematic plan view of the heating element molded integrally with the sole plate of FIG. 2.
Figure 6:
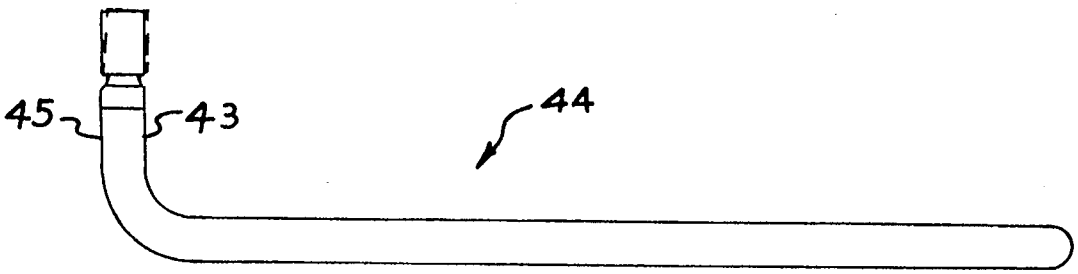
FIG. 6 is a schematic side elevation of the heating element of FIG. 4.
Figure 5:
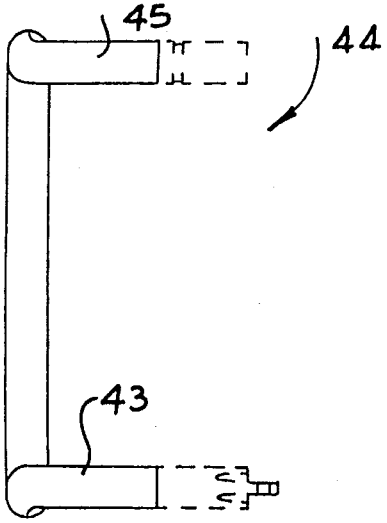
FIG. 5 is a schematic end elevation of the heating element of FIG. 4.
Figure 3:
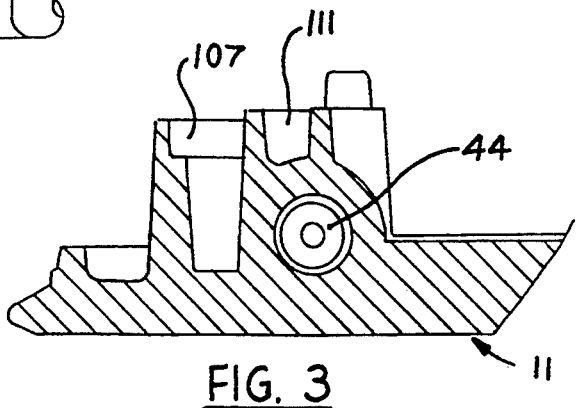
FIG. 3 is a schematic sectioned end elevation of a portion of the sole plate of FIG. 2 sectioned along the line 3—3.
Figure 8:
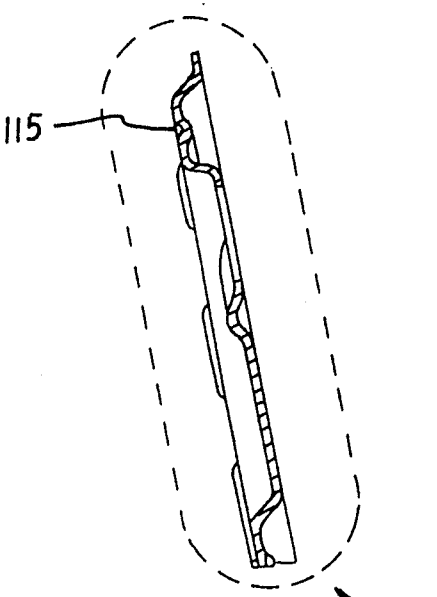
FIG. 8 is a schematic part sectioned end elevation of the sole plate of FIG. 7 sectioned along the line 8—8.
Figure 7:
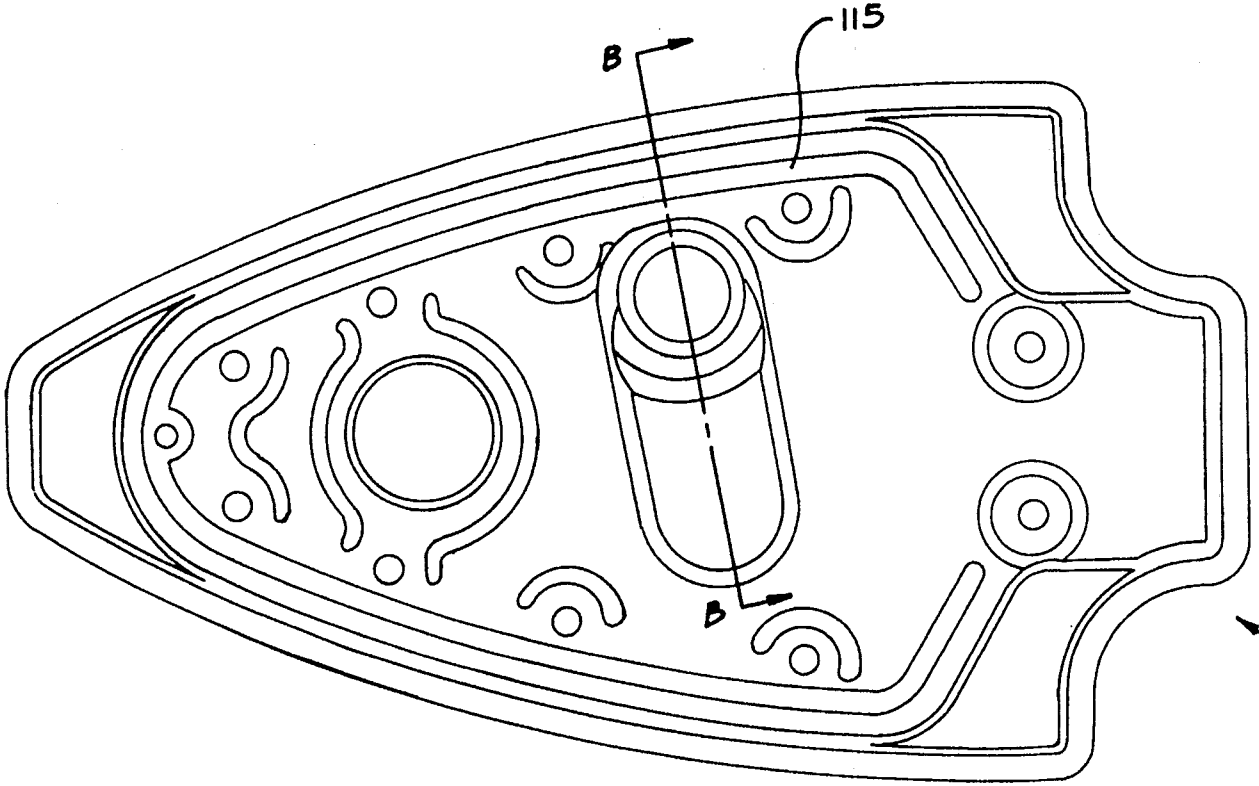
FIG. 7 is a schematic top plan view of the steam chest cover of the iron of FIG. 1.
Figure 9:
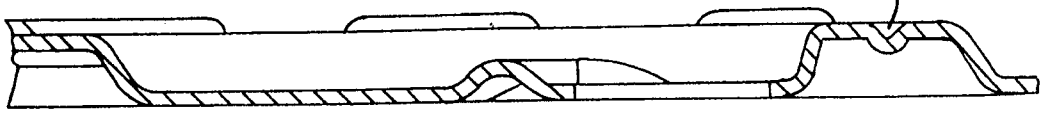
FIG. 9 is a schematic enlarged view of the section shown in FIG. 8.
Figure 11:
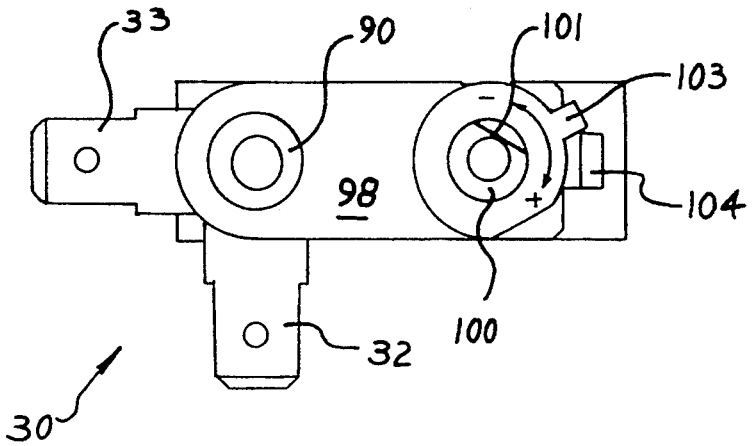
FIG. 11 is a schematic top plan view of the thermostat of FIG. 10.
Figure 10:
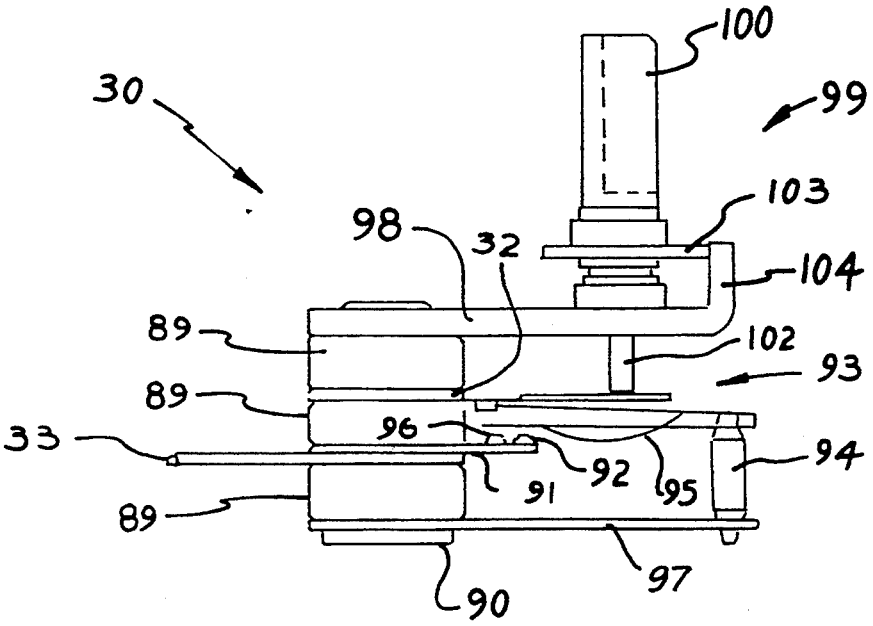
FIG. 10 is a schematic side elevation of a thermostat.

In the accompanying drawings there is schematically depicted a steam iron 10. The steam iron 10 includes a sole plate 11 upon which there is mounted an iron body. The body includes a skirt 13 and handle 16. Mounted within the body and on the sole plate 11 is a steam chest cover 12. Located so as to be housed within a cavity defined between the handle 16 and skirt 13 is a tank assembly 14. Located in forward cavities provided in the handle 16 is a pump assembly 17 and a valve assembly 18. The rear of handle 16 is closed by a rear cover 19 while there is housed in an upper cavity of the handle 16, a monitor control 20. The top cover 21 snap engages with the handle 16 to cover the control 20 while the forward cavities are closed by the pump cover 22 and the top cover 21. Also provided toward the front of the handle 16 is a filler cap 23 which is pivotally mounted so as to be angularly movable between a closed position abutting the handle 16 and a filling position exposing an opening through which water is poured into the tank assembly 14.

The pump assembly 17 has an actuation button 24 which projects above the top cover 21 and is manipulated by a user to deliver water for the purposes of producing bursts of steam. The valve assembly 18 delivers a generally constant stream in the production of a steady stream to be delivered beneath the sole plate 11. The rate at which water is delivered is determined by the steam dial 25 again manipulated by the user.

The rear cover 19 is provided with a cord grommet 26 which is pivotally mounted in a cradle 27 formed in the cover 19. The cord 28 passes through the grommet 26 so as to be supported thereby. The core 28 is provided with electric conduits 29 which deliver current for use in heating the sole plate 11.

Mounted on the sole plate 11 is a thermostat 30 which receives power via an active terminal 31 connected to the thermostat terminal 32. A further thermostat terminal 33 connects to a long busbar 34 connected in turn to a thermal fuse 35. Extending from the thermal fuse 35 is a short busbar 36.

The steam chest cover 12 is provided with an aperture 37 through which the thermostat 30 is attached to the sole plate 11. More particularly the sole plate 11 is provided with a thermostat mounting 38 which has a threaded aperture to engage the screw 39 which also passes through an aperture 40 to engage the mounting 38.

The sole plate is integrally molded with an element 44 which is of a generally "U-shaped" or "V-shaped" configuration so as to have a pair of legs 41 joined at an apex 42. Extending generally normal to the legs 41 are connections posts 43 and 45. The post 45 is electrically connected to the busbar 36 so as to receive power therefrom. The post 43 is connected to a mutual terminal 46 which in turn is electrically connected to a neutral link terminal 47 which is directly coupled to the neutral conduit of the cord 28. The neutral link terminal 47 is received within a slot 48 formed in the skirt 13, while the active terminal end portion 49 is received within a slot 50 of the skirt 13. Electrically extending between the end portion 49 and link terminal 48 is a neon assembly 51 which emits light whenever the iron is turned on.

Interposed between the active terminal 31 and the active lead of the cord 28 is the monitor control 20. The monitor control 20 detects when the iron has not been used and effectively turns it off. For example, if the iron has been stationary for more than 30 seconds and is in a horizontal orientation, the control 20 will effectively turn the iron off. Similarly if the iron is vertically oriented and is stationary for ten minutes, the control 20 will again effectively turn the iron off. The control 20 has a light which is turned on when the iron has been effectively turned off. The light is viewable through the lens 52 which is received within the top cover 21.

Extending operatively from the neon assembly 51 is a light pipe 53 which terminates at its upper end in the cavity of the handle 16. Accordingly the light can be seen whenever the iron is on. The upper end of the light pipe 53 is also provided with an indicator arm 54 which is the indicator for the temperature dial 55.

The pump assembly 17 includes a pump body 55 which has a cylindrical inner surface 56 which slidably receives a piston 57. The piston 57 is engaged by a piston rod 58 which In turn is engaged by the button 24. The piston and therefore the button 24 are biased upwardly means of a spring 59. Extending downwardly from the body 56 is an inlet connection 60 and an outlet connection 61. The inlet connection 60 is attached to a suction tube 62 while the outlet connection 61 is attached to a delivery tube 63. The valve assembly includes a valve ball 64 which co-operates with an internal valve seat to prevent reverse flow out the inlet connector 60. A further valve ball 65 co-operates with an internal seat to prevent reverse flow into the outlet connector 61. The ball 65 is biased against its valve seat by means of a spring 66. The valve balls 64 and 65 co-operate to ensure that water passes through the pump assembly 17 from the inlet connector to the outlet connector 61. The body 55 is formed integral with plugs 67 which are used to close apertures provided to facilitate assembly of the valve mechanisms within the pump assembly 17.

The valve assembly 18 includes the steam dial 25 which is rotatably supported by the top cover 21. The dial 25 slidably engages the steam dial insert 68 which is caused to rotate with the dial 25. The upper end of insert 68 is received within the dial 25 while a spring is also received within the dial 25 and biases the insert 68 downwards. The insert 68 is provided with a cam surface 69 which co-operates with a cain follower formed in the top cover 21. As the insert 68 is rotated, the co-operation of the cam follower with the cam surface 69 causes vertical movement of the insert 68. Snap engaged in the insert 68 is a valve stem 70 which has as its lower end step peripheral surfaces so that the transverse cross-sectional area of the lower part of the stem varies. The stem 70 co-operates with a steam valve 71 in regulating the flow of water from the tank assembly 14. More particularly the valve 71 permits water to flow from the tank assembly 14 to a predetermined location 72 on the sole plate 11. The lower portion of the stem 70 varies the effective valve opening of the valve 71 to regulate the flow of water. A steam valve seal 73 sealingly connects the valve 71 with a lower surface of the tank assembly 14.

The tank assembly 14 includes two tank halves 74 and 75 which co-operate to provide a tank chamber into which water is delivered via a delivery spout 76. The inlet spout is sealingly connected to the handle 16 by means of an O-ring seal 77. The opening of the spout 76 is exposed by pivotting the filler cap to its open position.

The seal 78 sealingly connects the stem 70 with the mounting 80 while the top gasket 79 mounts the delivery tube 63 in the mounting 81.

The tank halves 74 and 75 are provided with a slot 54*a* through which the light pipe 53 passes. The slot 54*a* extends from a central aperture 82 which provides for communication between the temperature dial 83 and the thermostat 30. More particularly the thermostat 30 projects upwardly through a raised portion 84 in the skirt 13 and through a raised portion 85 in the tank half 75. An aperture 86 is formed in the tank half 74 to permit the upper part of the thermostat 30 to project therethrough.

The tank halves 74 and 75 are also provided with an indent 87 to permit the delivery tube 63 to pass thereby without entering the tank assembly 14.

The dial 83 is rotatably supported and captively located in the tank half 74 which is exposed by an aperture in the handle 16. Attached to the dial 83 is a link 88 which couples the dial 83 with the thermostat 30 so that rotation of the dial 83 causes appropriate rotation of a portion of the thermostat 30 in order to regulate the temperature at which the thermostat 30 is activated.

The thermostat 30 is of a known and commercially available assembly. It includes a stack of insulating ceramic blocks 89 which are held in an assembly by a hollow rivet 90. Sandwiched between the blocks 89 is the terminal 33 which is held against a contact member 91 which is provided with a contact portion 92. Also held between the blocks 89 is the contact 32. Abutting the contact 32 is a spring assembly 93 which extends to a ceramic insulating post 94. The spring assembly 93 has a lower spring portion 95 provided with a contact portion 96 to co-operate with the contact portion 92. Also extending from the blocks 89 is a bi-metal strip 97 which extends to the post 94.

The upper end of the thermostat 30 has a bracket 98 supporting all actuator assembly 99. The actuator assembly 99 includes a post 100 which has a flat portion 101 engaged by the link 88 so as to be rotated thereby upon rotation of the dial 83. Housed within the post 100 is a threaded coupling which upon rotation of the post 100 causes vertical movement of a ceramic pin 102. The ceramic pin 102 is spring biased downward with rotation of the post 100 governing the tension in that spring. A stop member 103 engages a projection 104 to define a stop or stop positions for the post 100. By rotation of the post 100, the temperature at which the contact portions 92 and 96 part can be adjusted. The contact portions 92 and 96 are parted by heating of the bi-metal strip 97 which deflects upward taking with it the post 94 and causing the spring assembly to snap apart the contact portions 92 and 96. When the bi-metal strip 97 has cooled sufficiently, the spring assembly 93 again snaps so as to make contact between the contact portions 92 and 96.

As discussed previously, the screw 39 attaches the thermostat 30 to the mounting 38 by threadably engaging the threaded hole 105 formed in the sole plate 11. It should further be appreciated that the bi-metal strip 97 is positioned closest to the sole plate 11 so as to be responsive to the temperature changes therein.

As also discussed previously the heating element 44 is of a generally "U" or "V" configuration so as to have a pair of legs 41 joined by the base 42 or apex. However one of the legs 41 is provided with a portion 106 which deviates from the general path along which the leg 41 is located. The portion 106 is located adjacent the mounting 38 thereby ensuring that the thermostat 30 detects more accurately the temperature adjacent the heating element 44.

The sole plate 11 is formed with a plurality of fins 107 which radiate generally from the location 72 at which water is delivered by the valve assembly 18. The fins 107 aid in cooling the sole plate 11 regions adjacent the location 72 and aid in distributing the water over the sole plate 11.

The sole plate 11 is formed with a looped wall having an inner wall 108 and an outer wall 109. The inner wall 108 encompasses a steam chest 110 while located between the walls 108 and 109 is a channel 111. The channel 111 is located generally above the heating element 144. The pump assembly 17 delivers water to the channel 111 adjacent its forward end or apex. Accordingly bursts of steam to be generated are produced so by delivering pumped water to the hottest part of the iron, that is the forward portion of the element 44. The rear portions of the walls 108 and 109 are stepped to provide lower portions 112 to enable the steam within the channel 111 to escape. The steam generated in the channel and steam chest 110 is permitted to enter a void 113 surrounding the outer wall 109. Passages 114 extend through the sole plate so that the steam is delivered to the fabric being ironed.

Mounted directly above the sole plate 11 is the steam chest cover 12 which co-operates to enclose the steam chest 110, channel 111 and void 113. To enhance the delivery of the bursts of steam generated within the channel 111 there is provided in the cover 12 an elongated depression 115 which is located above the inner wall 108. Preferably flexible sealing material such as silicon rubber is delivered to the depression 115 to aid in sealing contact between the cover 12 and sole plate 11.

Forward and rear twist brackets 116 and 117 are fixed to the sole plate 11 and project upwardly through slots 118. The brackets 116 and 117 have twist tabs 119 which are twisted in order to secure the skirt 13 to the sole plate 11.

What we claim is:

1. An iron comprising:

a sole plate having an upper surface, the plate also having through apertures from which steam is discharged;

an iron body mounted on said sole plate and covering said upper surface;

a heating element in conductive heat contact with said sole plate;

a water tank in said body;

a steam chest bounded by a channel which overlays the heating element;

water delivery means for delivering water to a predetermined flat location continuous with the upper surface of the sole plate and within the steam chest; and at least one fin located inwardly of said channel within the steam chest and generally radiating from said flat location to assist in distributing the water over said sole plate and cool portions of the sole plate spaced from said location.

2. The iron of claim 1, wherein said sole plate has a rear end and a forward end, and wherein said forward end tapers to an apex with said predetermined location being spaced towards said apex, said sole plate is formed with a plurality of fins generally radiating from said location, which fins extend rearwardly from said location.

3. The iron of claim 2, wherein said heating element and said channel extend along a path which is generally complementary with respect to the shape of the sole plate.

4. The iron of claim 3, further including thermostat means operatively coupled to the sole plate to detect a temperature of said sole plate to regulate the delivery of current to said heating element, and wherein said path is located in a plane generally parallel to the sole plate and located towards the periphery of the sole plate, said path including a deviation extending towards said thermostat means so that said thermostat means is located adjacent to a portion of said heating element corresponding to the deviation of said path.

5. The iron of claim 4, wherein said channel surrounds the steam chest except for an opening leading to the apertures and located near the rear end of the sole plate.

6. The iron of claim 5, wherein said water delivery means includes a user operable pump which draws water from said tank and delivers it to said channel.

7. The iron of claim 3, wherein said path is V-shaped.

8. The iron of claim 3, wherein said path is U-shaped.

9. The iron of claim 2, wherein said channel is formed by inner and outer walls, said inner wall bounding said steam chest, said apertures being located between said outer wall and an outer perimeter of said sole plate.

10. An iron comprising:

a sole plate;

an iron body mounted on the sole plate;

a heating element in contact with said sole plate to heat the sole plate upon delivery of electric current to said element;

thermostat means mounted to detect a temperature of the sole plate to regulate the delivery of current to said heating element; and wherein said heating element is elongated so as to follow a path located in a plane generally parallel to the sole plate and located towards the periphery of the sole plate, said path including a pair of substantially straight legs joined together at one of the ends thereof, one of said legs having a bend therein forming an obtuse angle in said one leg and defining a local deviation in said one leg extending towards said thermostat means so that said thermostat means is located adjacent to a portion of said heating element corresponding with the deviation of said path.

11. The iron of claim 10, wherein said path is V-shaped.

12. The iron of claim 10, wherein said path is U-shaped.

13. An iron comprising:

a sole plate having exterior and interior surfaces, said plate further having apertures through which steam is delivered to the exterior surface of the sole plate;

an iron body mounted on said sole plate and covering said interior surface;

a heating element in conductive heat contact with said sole plate to heat the sole plate upon the delivery of electric current to said heating element;

a water tank in said body;

water delivery means to deliver water from said tank to said interior surface of the sole plate to generate steam for delivery to said apertures, said water delivery means having an outlet to direct water to a predetermined location on said interior surface of the sole plate; wherein said heating element is elongated and said sole plate at least partly encloses an elongated chamber extending along said heating element, said chamber being substantially closed and containing said predetermined location so that upon delivery of water to said location steam is generated in said chamber from where it is delivered via an outlet to said apertures;

further including thermostat means operatively coupled to said sole plate to detect a temperature of the sole plate to regulate the delivery of current to said heating element, and wherein said heating element is elongated so as to follow a path located in a plane generally parallel to the sole plate and located towards the periphery of the sole plate, said path including a deviation extending towards said thermostat means so that said thermostat means is located adjacent to a portion of said heating element corresponding with the deviation of said path.

14. The iron of claim 13, wherein said path is V-shaped.

15. The iron of claim 13, wherein said path is U-shaped.

16. An iron comprising:

a sole plate having an upper surface, the plate also having through apertures from which steam is discharged;

an iron body mounted on said sole plate and covering said upper surface;

a heating element in conductive heat contact with said sole plate;

a water tank in said body;

a steam chest bounded by a channel which overlays the heating element;

a water delivery means for delivering water to a predetermined flat location continuous with the upper surface of the sole plate and within the steam chest;

wherein the sole plate has a rear end and a forward end, the forward end tapering to an apex, said predetermined location being located toward said apex, the upper surface of the sole plate further comprising a plurality of fins radiating from said location and extending rearwardly from said location, the fins assisting in distributing water over said upper surface of the sole plate at least in part by cooling portions of the sole plate spaced from said location.

17. The iron of claim 16, wherein said fins are elongated, relatively thin members in adjacent, spaced relation for distributing the water between adjacent fins from said location towards said rear end of the sole plate.

18. The iron of claim 17, wherein said sole plate has an open space which communicates with the spaces between the fins and with said channel so that water flows into the spaces between the fins and into said channel and is converted to steam which flows into said open space and then to said apertures.

19. The iron of claim 18, wherein said channel includes walls bounding said open space to produce a reversal of flow of steam from the steam chest to said apertures.

20. The iron of claim 19, wherein said walls define a passage from the steam chest to said open space in which steam flow is constricted.

* * * * *